US010220280B2

(12) United States Patent
Corcoran

(10) Patent No.: US 10,220,280 B2
(45) Date of Patent: Mar. 5, 2019

(54) GOLF CLUB HEAD COVER DEVICE

(71) Applicant: Jerry Alvin Corcoran, Canby, OR (US)

(72) Inventor: Jerry Alvin Corcoran, Canby, OR (US)

( * ) Notice: Subject to any disclaimer, the term of this patent is extended or adjusted under 35 U.S.C. 154(b) by 20 days.

(21) Appl. No.: 15/663,289

(22) Filed: Jul. 28, 2017

(65) Prior Publication Data

US 2017/0326424 A1 Nov. 16, 2017

Related U.S. Application Data

(63) Continuation-in-part of application No. 14/599,702, filed on Jan. 19, 2015, now abandoned.

(51) Int. Cl.
*A63B 57/00* (2015.01)
*A63B 60/62* (2015.01)
*A63B 60/64* (2015.01)

(52) U.S. Cl.
CPC ..... *A63B 60/62* (2015.10); *A63B 60/64* (2015.10); *A63B 2209/08* (2013.01); *A63B 2209/10* (2013.01); *A63B 2209/14* (2013.01)

(58) Field of Classification Search
CPC ..... A63B 55/007; A63B 57/0087; A63B 2209/10; A63B 2209/08; A63B 47/04; A63B 60/62; A63B 60/64
USPC ..... 150/154, 160; 206/315.2, 315.4; D21/754
See application file for complete search history.

(56) References Cited

U.S. PATENT DOCUMENTS 2,128,546 A * 8/1938 Venmore ..... A63B 55/00 211/70.2
3,664,399 A * 5/1972 Neff ..... A63B 60/62 150/160
4,195,677 A * 4/1980 Hagg ..... A63B 60/62 150/160
5,000,238 A * 3/1991 Zeller ..... A63B 60/62 150/160
5,005,624 A * 4/1991 Sung ..... A63B 60/64 150/160
5,437,320 A * 8/1995 Sung ..... A63B 60/62 150/160
5,779,042 A * 7/1998 Kaneko ..... A63B 55/406 150/159
6,298,987 B1 * 10/2001 Clark ..... A63B 60/62 206/315.2

(Continued)

*Primary Examiner* — Fenn C Mathew
*Assistant Examiner* — Cynthia Collado
(74) *Attorney, Agent, or Firm* — Mark S Hubert

(57) ABSTRACT

A user-friendly golf club head cover system adapted for full operation while never leaving its spot in the golf bag. It allows access to the club via a simple downward physical movement of the incorporated tube. The club head cover portion remains open until the golf club is reinserted into the system. The club head cover has a partially connected top panel that is closed via a simple upward physical movement of the incorporated tube. An internal spring panel or solid body structural top panel with residual biases may assist the opening and closing of the top panel. A series of rods maintain the golf club head cover in the golf bag. A magnetic closure keeps the club head cover portion closed. The opening and closing may be facilitated by manual manipulation of the top panel alone.

13 Claims, 8 Drawing Sheets

(56) References Cited

U.S. PATENT DOCUMENTS

| | | | | |
|---|---|---|---|---|
| 2008/0230159 | A1* | 9/2008 | Tan | A63B 60/62<br>150/160 |
| 2015/0083291 | A1* | 3/2015 | Solheim | A63B 60/64<br>150/160 |

* cited by examiner

GOLF CLUB HEAD COVER DEVICE

This continuation-in-part utility patent application claims domestic priority from utility application Ser. No. 14/599,702 filed Jan. 19, 2015 and entitled "GOLF CLUB HEAD COVER DEVICE."

BACKGROUND OF THE INVENTION

The present invention relates to an extremely compact system for a golf club's quick, unhampered removal from, and insertion into, it's club head cover. More particularly, to a user friendly golf club head cover device adapted for full operation while never leaving its spot in the golf bag.

Americans have a love for the game of golf, and for this reason the sport is growing in popularity. As it does, there are more players on the course and playing time becomes more critical. Many courses do not allow golfers to walk anymore and have mandated the use of golf carts. Simply stated, golfers are sensitive regarding their wait time to tee off each hole. Additionally, golf clubs are expensive and somewhat sensitive to prolonged contact with the elements. As such, golfers cloak the heads of their golf clubs with removable, protective covers. Installing and removing these covers is time consuming. Typical designs involve zippers, hook and loop fasteners, stretchable fabric and the like. Once removed, these club head covers must be placed somewhere until it is reinstalled. Commonly, they end up on the ground, causing their aesthetic deterioration.

Henceforth, an inexpensive, quick, golf club head cover system which could remain in the golf bag and require a minimal amount of physical manipulation to open, and close would fulfill a long felt need in the golfing industry. It would decrease the time needed at each tee to extract and replace the golf club. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide an inexpensive, compact golf club head cover device that does not have to leave the golf bag, and requires simple physical movements to both remove it and install it on the club head.

It has many of the advantages mentioned heretofore and many novel features that result in a new golf club head cover device which is not anticipated, rendered obvious, suggested, or even implied by any of the prior art, either alone or in any combination thereof.

In accordance with the invention, an object of the present invention is to provide an improved golf club head cover device that upon removal of a club, readies its physical configuration for a quick reinsertion of the same club.

It is another object of this invention to provide an improved golf club head cover device capable of auto closing itself about the golf club head after reinsertion of the club.

It is a further object of this invention to provide an improved golf club head cover device that requires a minimal amount of physical manipulation to open.

It is still a further object of this invention to provide for an improved golf club head cover device that may be maintained at all times on the golf bag.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

DETAILED DESCRIPTION

Figure 1:
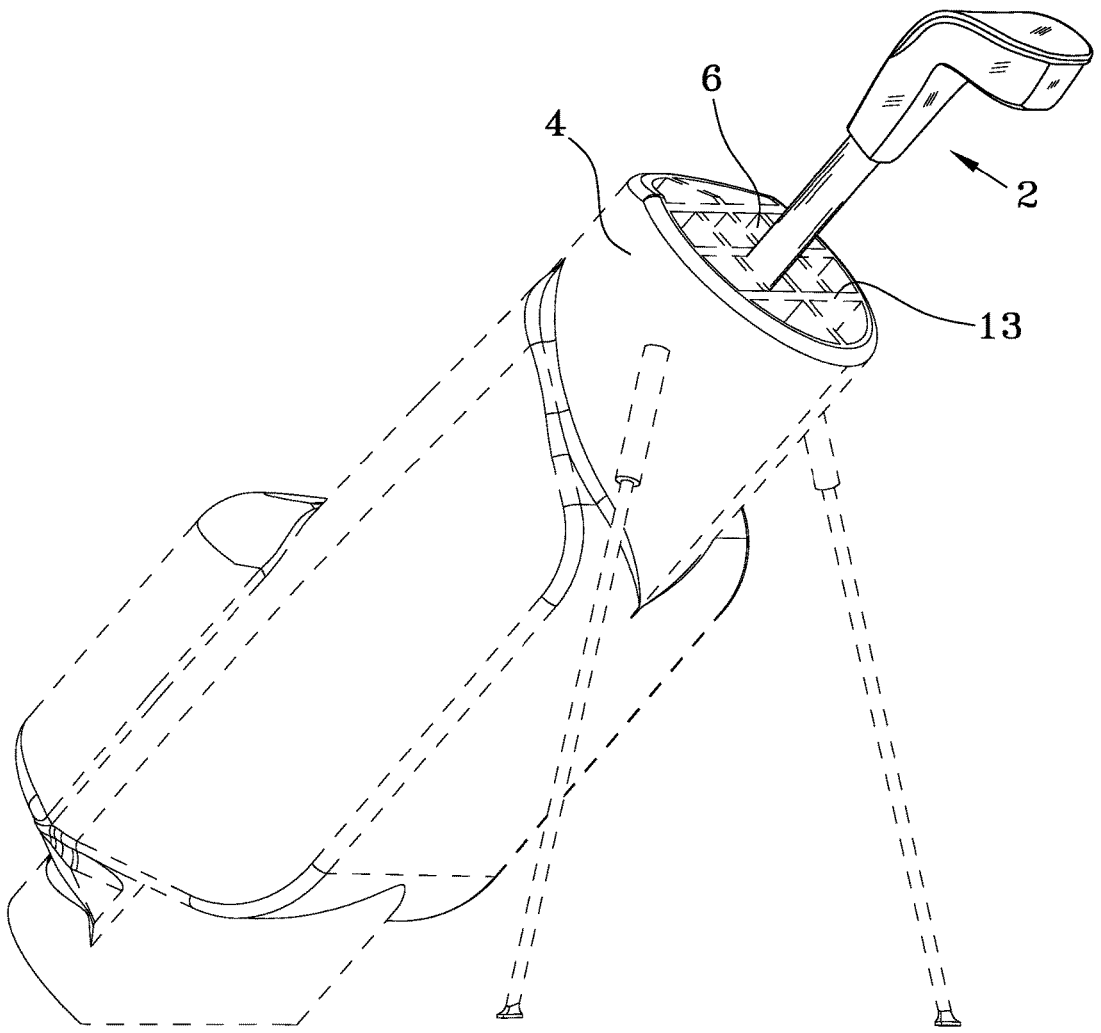
FIG. 1 is a perspective front side view showing the general arrangement of all components of the golf club head cover device in its closed position on a club that resides in the golf bag.
Figure 2:
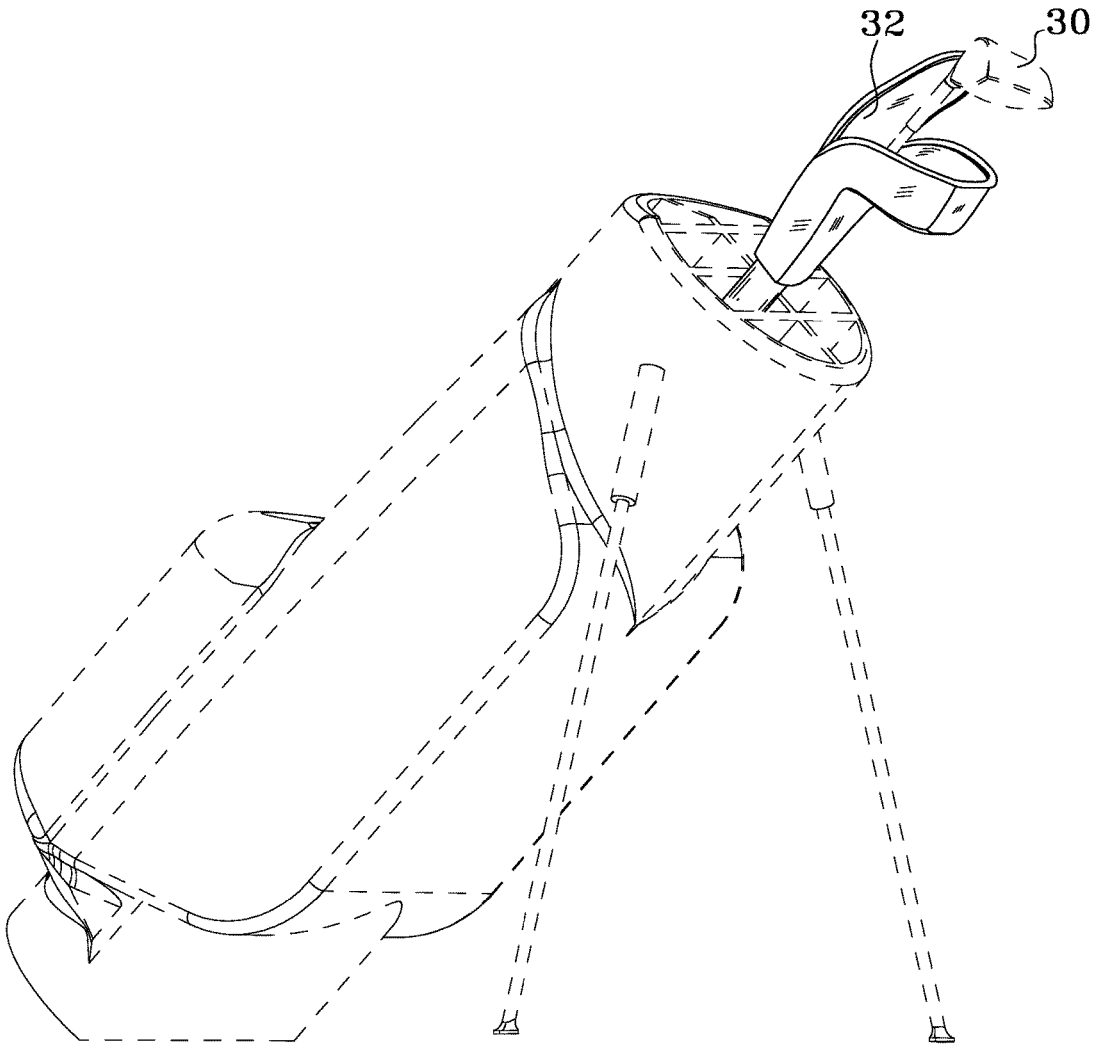
FIG. 2 is a perspective front side view showing a lowered golf club head cover device in its open position on a club that resides in the golf bag.
Figure 3:
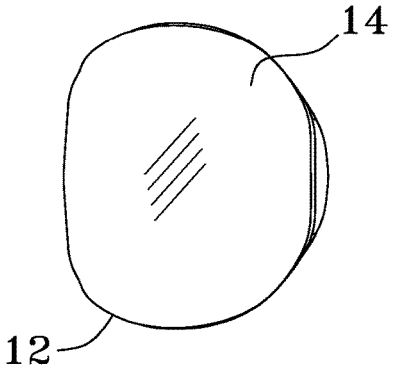
FIG. 3 is a top view of the golf club head cover device.
Figure 4:
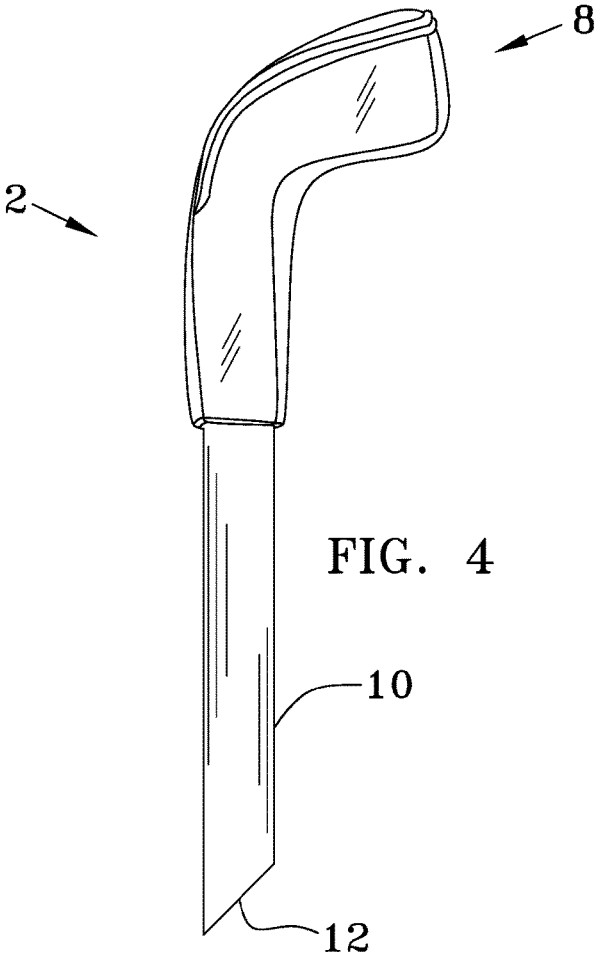
FIG. 4 is a side view of the golf club head cover device.
Figure 5:
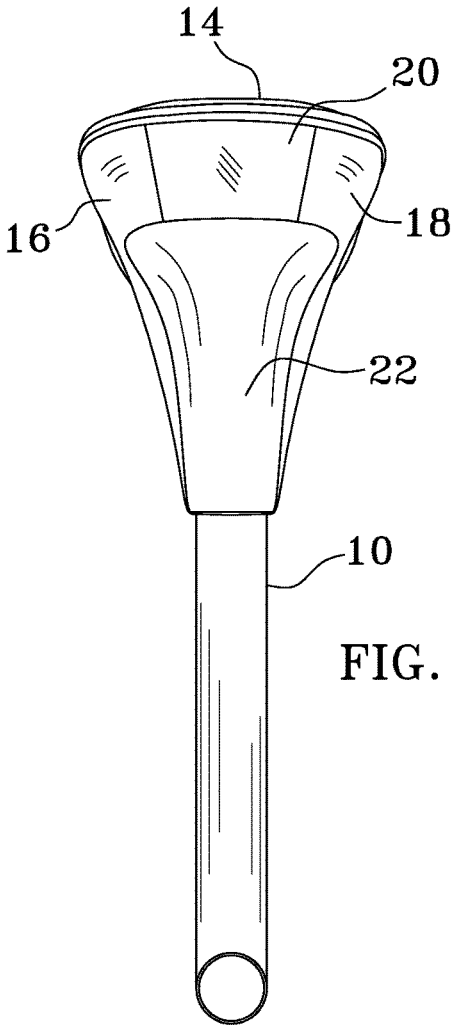
FIG. 5 is a front view of the golf club head cover device.
Figure 6:
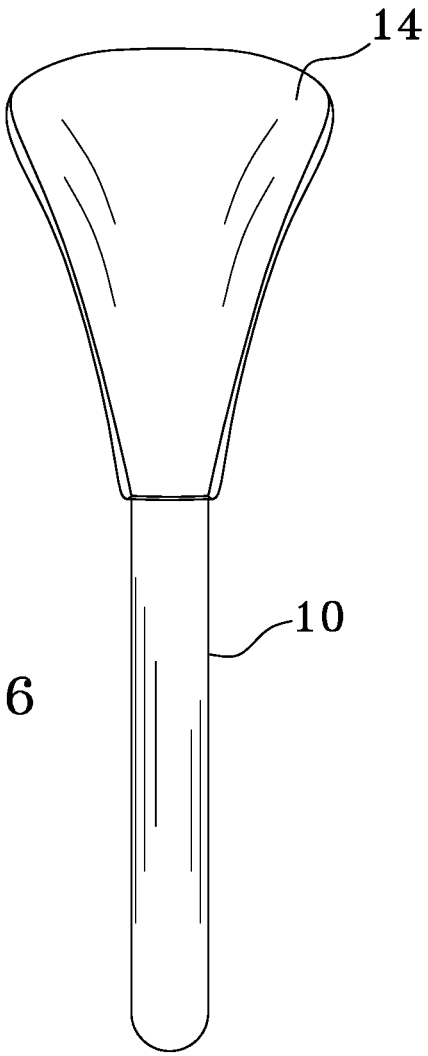
FIG. 6 is a rear view of the golf club head cover device.
Figure 7:
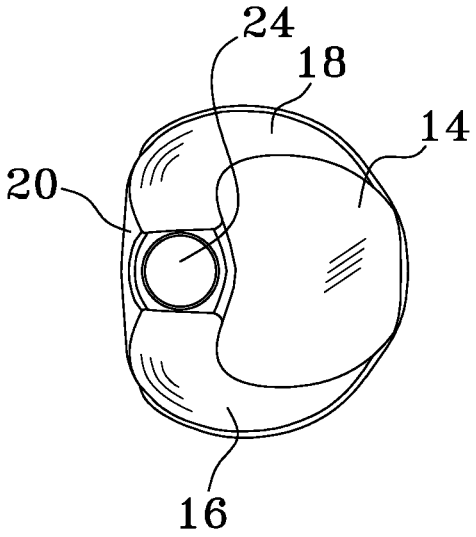
FIG. 7 is a bottom view of the golf club head cover device.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

FIG. 1 illustrates the golf club head cover device 2 in place over a golf club head that resides in the interior 6 of a golf bag 4. The golf bag 4 may have a single cavity interior design or may have a divided interior design. Golf bags 4 commonly have divided interiors that function to keep the shafts of the golf clubs, parallel and organized within the golf bag 4. As can be seen, when installed on a golf club head, the device 2 sits high out of the bag 4 but not enough to expose the bottom of linear member 10.

Looking at FIGS. 3-8 the parts of the golf club head cover device 2 can best be seen. The golf club head cover device 2 consists of a flexible fabric club head cover 8 permanently affixed at its bottom to the proximate end of a linear member 10 that extends partially into the interior of the golf bag 4 (divided or otherwise.) In the preferred embodiment there is an intermediary gusset member 34 that connects the rod linear members 44 to the club head cover 8. The linear member 10 must not extend to the bottom of the golf bag 4. In one embodiment the linear member 10 is a cylindrical tube with an angular distal end 12 (for ease of installation onto a divided cavity golf bag) although it is known that the linear member may be any number of any of a plethora of rigid members such as a rod/s (FIGS. 13 and 14), a U shaped channel (FIGS. 10 and 11), a partially U shaped channel, a reinforced fabric strip, etc.

Figure 13:
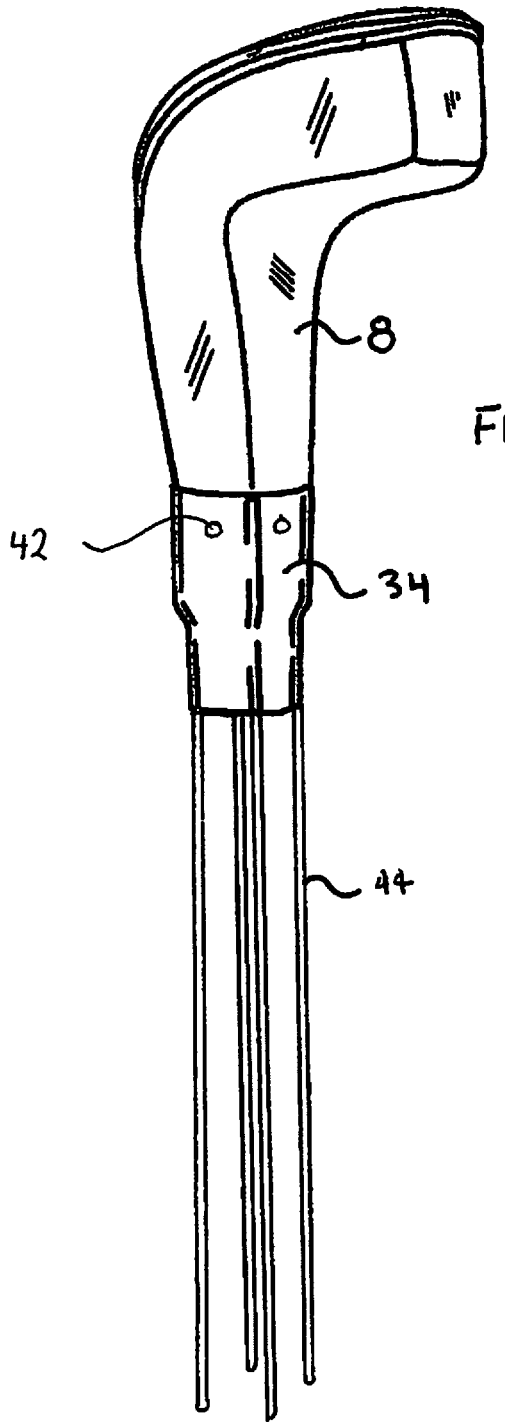
FIG. 13 is a side perspective view of the golf club head cover device showing a second alternate embodiment rod linear member.
Figure 14:
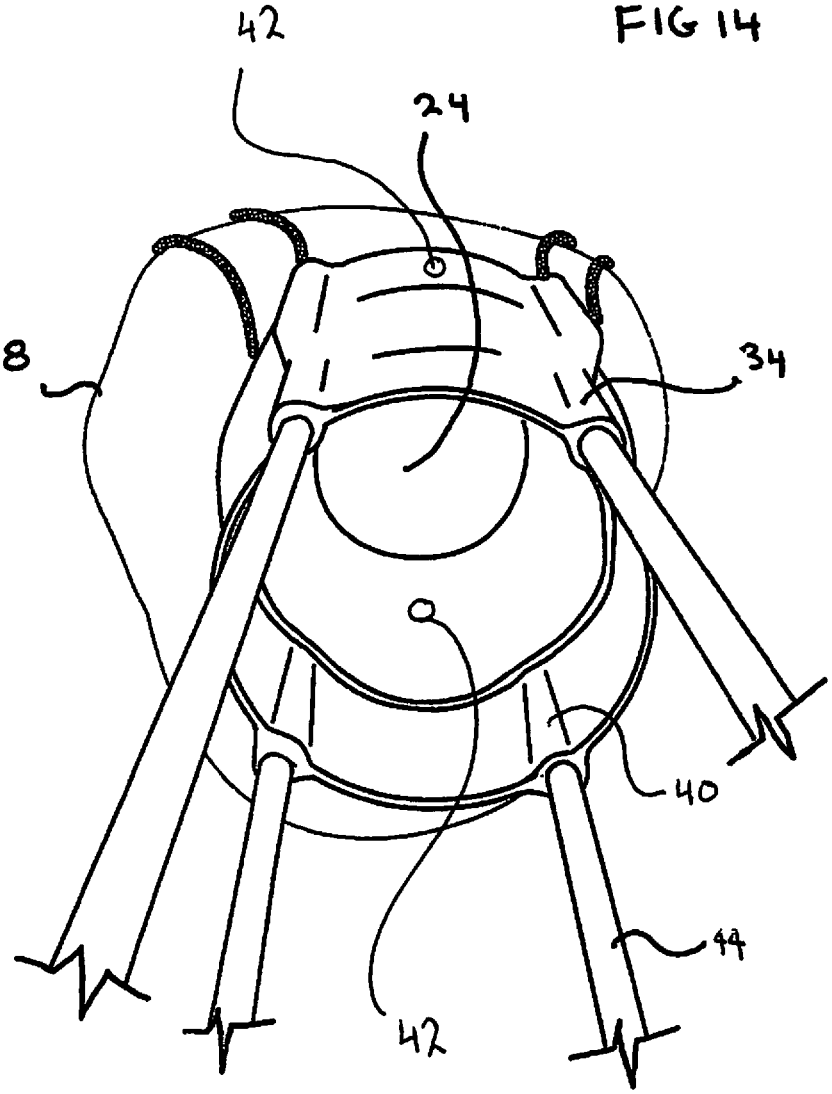
FIG. 14 is bottom perspective view of the golf club head cover device showing a second alternate embodiment rod linear member.

As can be seen in FIGS. 13 and 14, when the preferred embodiment rigid rod configuration of linear member (rod) 44 is used, it will incorporate a gusset member 34 at the interface between the golf club head cover 8 and the rod linear member 44 to conjoin the rod configuration linear member 44 and the golf club head cover 8. Multiple rods 44, preferably four, will be used to support the gusset plate 34 and the golf club head cover 8 above the top of the golf bag. The gusset plate 34 can have numerous configurations but must be configured to accept the retention of the distal ends of the rods 44. In the preferred embodiment, the gusset member 34 will be of a hollow cylindrical shape. In the gusset member 34, there will be cylindrical recesses 40 formed therein to accept the partial insertion of these multiple rods 44 about its length. These rods 44 may be frictionally fit into these recesses 40 or they may be affixed therein with mechanical fasteners, as is well known in the industry, welded in place, or affixed by gluing.

As discussed above, the alternate embodiment linear members 10 are permanently affixed to the bottom of the club head cover 8 in the region adjacent the circular opening 24 by gluing or a mechanical means as is well known in industry. The rod configuration of linear member 44, is similar to that of the alternate embodiment embodiment linear members 10, in that they each at least partially encase the golf club shaft when the golf club head cover device 2 is placed over a golf club head that resides in the interior 6 of a golf bag 4.

As with all linear member embodiments, the rods 44 extend partially into the interior of the golf bag 4 yet must not extend to the bottom of the golf bag 4. The gusset member 34 may be affixed to the bottom of the golf club head cover 8 in a plethora of ways with or without mechanical fasteners 42 such as stitches, rivets, or blind nuts and bolts or by adhesive bonding or ultrasonic and dielectric welding as is well known in the industry.

Similar, to the cylindrical tube embodiment linear member and the alternate embodiment partially U shaped channel linear member, the preferred embodiment rod configuration linear members 44 form a rectangular frame having a diameter larger than the outer diameter of the golf club shaft, yet smaller than the minor dimension of bag divider 13 (so that the golf club shaft can be raised through the linear member 10 while the linear member 10 remains in the golf bag.) Although the preferred embodiment rod configuration linear member 44 illustrated in FIGS. 13 and 14 has been discussed above as made of a plethora of rods, the configuration of four rods is used herein.

Figure 10:
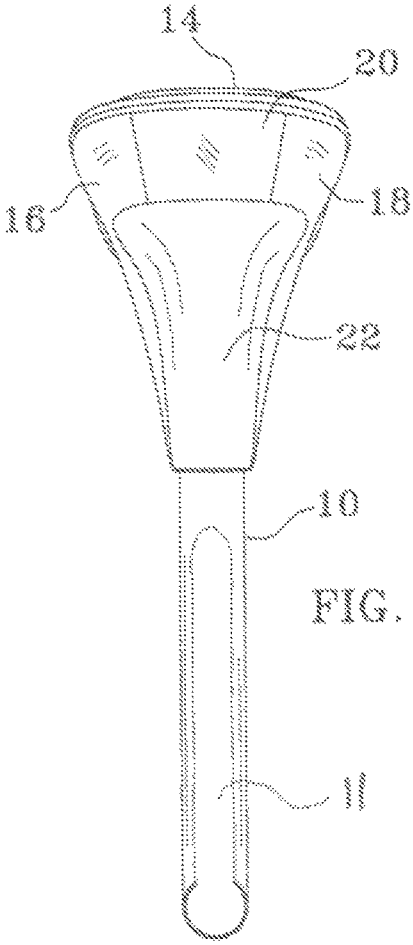
FIG. 10 is a front view of the golf club cover device with an alternate embodiment linear member.

The inexpensive, commercially available, lightweight, polymer golf bag tube has been found quite suitable for this application. This club head cover 8 is basically a sleeve body sized for the enclosure of a golf club head (generally a wood or driver) therein. The linear member 10 has an inner diameter or inner bounder space larger than the outer diameter of the golf club shaft, yet smaller than the minor dimension of bag divider 13. FIG. 10 shows another alternate embodiment of the golf club head cover device 2 wherein the linear member 10 has the configuration of a partially U shaped channel—which can be accomplished by removing a portion of a golf club tube. The slotted section 11 can be seen cut into the front side of the linear member 10. It is to be noted that in another embodiment, that the linear member (regardless of configuration) may also be covered with the same fabric that the club head cover 8 is made of.

The club head cover 8 is comprised of several connected but partially separable, flexible panels. Generally, in the preferred embodiment, the panels are constructed of a fabric although thin skin polymers are also well adapted for this purpose. Although sewing/stitching is the preferred method of permanent connection between the panels, other methods of mechanical connection between the panels may also be utilized if they also provide durability, strength and leak-tightness, including but not limited to heat sealing, adhesive bonding, ultrasonic and dielectric welding, and laser seaming.

The back top panel 14 is a single piece that extends from the interface between the club head cover 8 and the linear member 10 and extends over the entire upper surface or top of the remainder of the club head cover 8. In its preferred embodiment, it is permanently joined to the approximately bottom one-third of the upper perimeter of a curved left side panel 16, and the approximate one-third of the upper perimeter of a mirror image curved right side panel 18. (Although this may vary between the bottom one sixth and bottom one half of the curved side panels 16 and 18 as detailed herein.) Between the left side panel 16, and right side panel 18 connecting these side panels, resides a central panel 20. This central panel 20 has no permanent connection to the back top panel 14. A bottom panel 22 is connected to the lower perimeter of the left side panel 16, the lower perimeter of the right side panel 18 and the lower perimeter of the central panel 20. The overall configuration of the club head cover 8 is that of a curved tapering, flexible sleeve having a back top panel 14 that is partially separable from a curved body. The curved body is made of a series of conjoined panels or from a single panel and resides in a generally horizontal position. The back top panel 14 resides in a vertical position when open to form a throat between it and the curved body, and in a horizontal position when closed.

Although illustrated as having 5 panels, it is known that the critical design feature of the club head cover 8 is that of the separate top panel 14. The remainder of the club head cover 8 may be made of a different configuration of panels provided that they form a flexible shell for a golf club head that narrows to surround the shaft/golf club head interface.

The bottom end of the bottom panel 22 the left side panel 16, the right side panel 18 and the back top panel are connected so as to form a circular opening 24 at the bottom of the club head cover 8 through which the golf club shaft can pass. In the region adjacent the circular opening 24 the linear member 10 is affixed to the club head cover 8. The rod linear member 44, in the preferred embodiment, surrounds the golf club shaft when the golf club head cover device 2 is placed over a golf club head that resides in the interior 6 of a golf bag 4. This may be done in a plethora of ways including stitching, bolting or other mechanical fastening, adhesive bonding, ultrasonic and dielectric welding. Small gusset members may alternatively be utilized with or without mechanical fasteners such as rivets, or blind nuts and bolts (to name a few), as is well known in the industry.

Since the back top panel 14 is only fixed about its bottom one third to the side panels 16 and 18, the upper two thirds of the back top panel 14 is free to be opened and flexed up and back away from its closed position so that its approximate upper two thirds are not in contact with the sides 16 and 18. The material used for construction of the back top panel 14 is selected for its rigidity and memory. This panel, while being held magnetically in a curved closed deformed configuration as illustrated in FIG. 1, has residual forces within that continually urge it to return to its planar shape. These forces come from a spring panel, which may be incorporated into the physical structure of the top back panel or may be the actual top back panel itself.

Proper selection of the material and material thickness for this back top panel 14 is one way of accomplishing permanent, strong enough residual forces in the back top panel 14 so that when contact between the upper and lower magnetic lips is broken, the back top panel 14 will move to its vertical position. With the right combination of material chosen and top back panel thickness, the top back panel is the spring panel. In this embodiment, the top back panel is an individual, single, solid piece, made of but one material throughout and possessing the residual forces strong enough to function as an openable and closeable panel that can be held in the closed configuration with a closure member strong enough to overcome these residual forces present when the top back panel is in the fully closed position. Thus it functions as its own spring panel without the need for an imbedded or separate spring panel to be incorporated into the top back panel.

Figure 12:
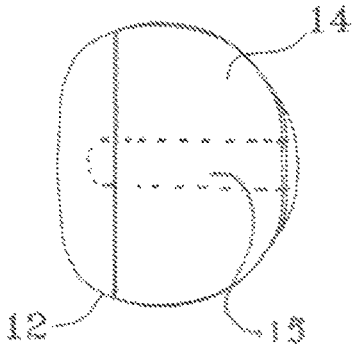
FIG. 12 is a top view of an alternate embodiment golf club cover device with the spring panel shown in phantom.
Figure 11:
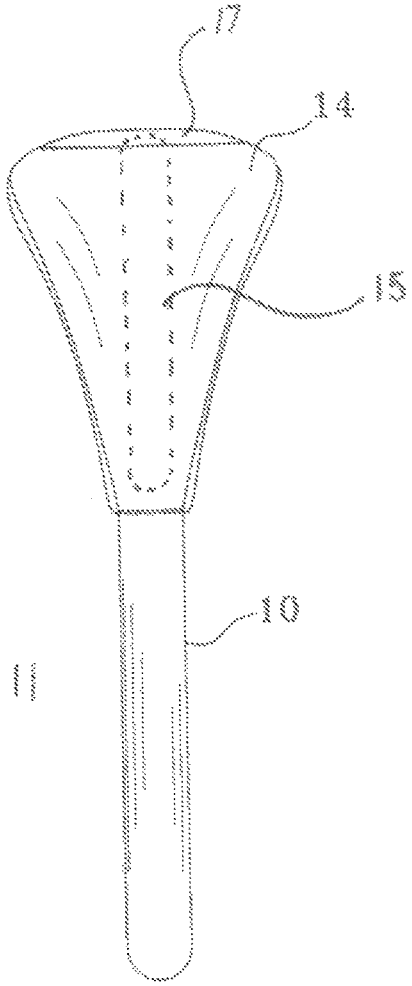
FIG. 11 is a back view of an alternate embodiment golf club cover device with the spring panel shown in phantom.

Alternatively, as can be seen in the alternative embodiments shown in FIGS. 10 and 11, a spring panel 15 that maintains a constant force to urge the top back panel 14 into a vertical planar configuration is incorporated into the back top panel 14 between its inner and outer faces. The spring panel 15 has a linear configuration. It has a top end that resides adjacent to the leading edge of the back top panel 14 and a bottom end that is affixed at the interface/junction of the cover with the linear member. Such a device may be as simple as a rigid, thin planar sheet of thin metal or plastic that has been affixed to the back top panel 14 by sewing, gluing, welding, etc. or just positioned between the outer (upper) and inner (lower) faces of the top back panel. Looking again at FIGS. 11 and 12, the spring panel 15 can be seen in a ghost image, residing beneath the outer face of the back top panel 14. It resides entirely within the body of the golf club head cover, and extends from the top leading edge of the back top panel 14 down to the connection point between the linear member 10 and the club head cover 8. Generally the spring panel 15 will be connected between these two, with the attendant mechanical connectors passing through the spring panel's thickness and holding the spring panel rigidly and vertically from this connection point.

There are two different types of linear spring panels. One merely biases the back top panel straight for when the golf club is out of the device 2. It can be made out of a thin linear strip of metal wherein its width and thickness is optimized to provide enough residual force to hold the back top panel 14 straight but yet not strong enough to overcome the magnetic or hook and loop holding force of the device's closure mechanism. The other spring panel 15 biases the back top panel in the curved closed deformed configuration of FIG. 1 discussed herein, yet when straightened (as in FIG. 9 when the club is removed from the device 2) retains the back top panel 14 in the upward "open" position.) Here, the spring panel 15 is a thin piece of metal having a deformable curl along its longitudinal axis with a slight curve set therein across its width, so as to allow it to remain rigid in the fully extended position yet when its leading edge is urged forward, will attempt to curl toward the front of the device 2. This second type of spring panel 15 is commonly used in coiling rulers. This second type of spring panel 15, eliminates the need for the device's magnetic or hook and loop closure mechanism. It is to be noted that the insertion of either of these linear spring panels 15 may facilitate the use of a reinforcement strip 17 across the leading edge of the front end of the back top panel 14.

It is to be noted that generally, for the optimal operation of the opening and closing of the back top panel 14, this panel must not have the permanent affixation to the sides extending more than one half of its height, and not less than one sixth of its height as measured with the panel 14 in its open vertical position.

Figure 8:
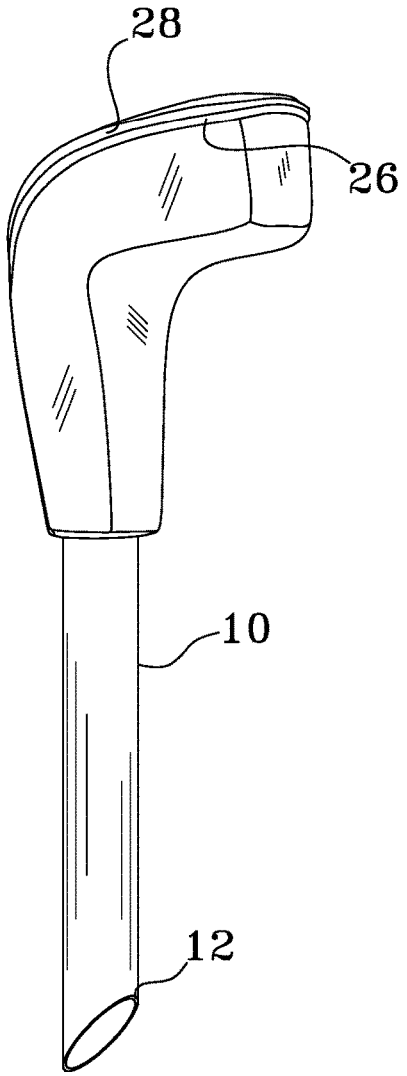
FIG. 8 is a perspective front view of a closed golf club head cover device.
Figure 9:
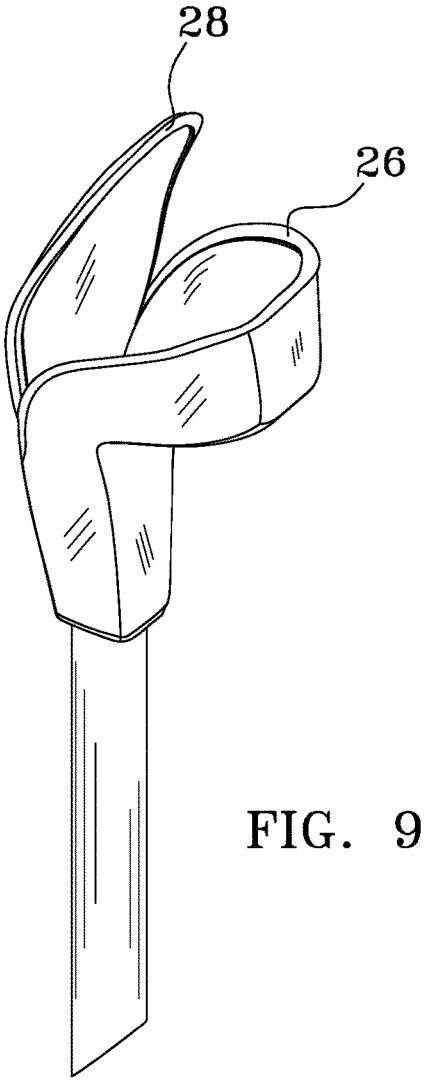
FIG. 9 is a perspective front view of an open golf club head cover device.

Looking at FIGS. 8 and 9, it can be seen that about the perimeter of the left side panel 16, the right side panel 18 (in the area not permanently affixed to the back top panel 14) and the central panel 20 (along its upper edge), is a contiguous, lower flexible magnetic lip 26. Similarly, about the perimeter of the back top panel 14 (in the area not permanently affixed to the left side panel 16 and the right side panel 18) is an upper magnet lip 26. These magnetic lips 24 and 26 are shaped for mating magnetic engagement. The attraction between these two magnetic lips 24 and 26 is strong enough to keep the golf head club cover closed, maintaining contact between the back top panel 14, the left side panel 16, the right side panel 18 and the central panel 20 despite the forces attempting to return the back top panel 14 to its relaxed, planar open configuration. In an alternate embodiment, there need be only a first portion of a magnetic closure on the back top panel 12 and a second portion of a magnetic closure either on one or all of the side and central panels.

In the preferred embodiment, the linear member is multiple rods, generally made of a polymer or steel and optionally cut at an acute angle at their distil ends 12. Also typical hollow, open ended, cylindrical golf club tube works well. The angle cut allows for the easy insertion of the device 2 into the divided compartments 6 of a conventional golf bag 4. The inner available space in the linear member exceeds the outer diameter of the shaft of a golf club including the gripping, so that the golf club shaft can be raised through the linear member while the linear member remains in the golf bag.

In operation, the design of the preferred embodiment golf club head cover device 2 can best be explained in reference to FIGS. 1, 2, 8, 9, 13 and 14. The golf cub head cover device 2 is inserted into a golf club bag 4. (See FIG. 1) The device 2 is held by the rod linear members 44 while the back top panel 14 is peeled up and back from the rest of the club head cover 8. The back top panel 14 is released wherein it's residual forces will maintain it in a generally planar, vertical configuration. (See FIG. 9) The golf club is inserted, shaft first into the throat of the opening created between the back top panel 14 and the remainder of the club head cover 8. The back top panel 14 is then pulled downward until its upper magnetic lip 26 contacts the lower magnetic lip 24 which is attached and residing in a contiguous line along the central and side panels 16, 18 and 20. Magnetic attraction holds the head cover enclosure 8. This procedure is followed the first time the device 2 is used. Thereafter the use is greatly simplified and proceeds as discussed below.

As described below, the rod linear members 44 are the operational handles that the golfer uses to initiate the opening and closing of the back top panel 12. The user grabs the rod linear members 44 and gently pulls them downward. This action causes the rod linear members 44 to move further down into the golf bag 4 and the golf club head 30 to contact the inner face of the back top panel 12 pushing this panel upward so as to break the magnetic attraction that holds the club head cover 8 closed. (See FIG. 2) The back top panel 14 then moves to its vertical relaxed position as the club head 30 reveals itself inches above the opened head cover enclosure 8. While the player makes his shot the club head cover 8 remains open, awaiting insertion of the club. Upon reinsertion of the club head through the open throat of the head cover enclosure 8 the golfer merely grabs the liner member 44 and pulls it upward until the club head contacts the inner face of the bottom panel 22. This causes an axial jarring to the back top panel 14 such that it tips forward and reaches a point of magnetic attraction between its upper magnetic lip 28 and the lower magnetic lip 24 that is strong enough to overcome the residual forces trying to maintain the back top panel 14 vertical, and closes the device."

In this manner, utilizing the rod linear members 44 as the operational handle to initiate the opening and closing the back top panel 14, the club head cover 8 never leaves the bag, the golfer does not have to fiddle with zippers, hook and loop fasteners, dome fasteners, laces and the like to get his club in and out of it's protective cover. Additionally, the insertion of the golf club into the device 2 is aided by the maintenance of an open throat configuration established by the process of pulling down the rod linear member 44. (See FIG. 9) The only motions required by the golfer is the gentle downward jerk of the rod linear member 44 into the bag 4 to open the club head cover 8 and the reverse gentle upward jerk of the tube to close the club head cover 8."

Although the above method of closing the back top panel 14 discusses using the abrupt upward motion of the linear member 10 to bring into motion a series of events that closes the device, if the linear member is gently raised until the club head lightly contacts the inner face of the bottom panel 22, the golfer may manually grab and tip the back top panel 14 forward until it reaches the point of magnetic attraction with the lower magnetic lip 24 to close the device.

In an alternate embodiment, the upper magnetic lip 28 and the lower magnetic lip 24 may be replaced with connectable halves of a flexible fabric, hook and loop fastener. With this embodiment, the operation to open and close the device would remain unchanged although there would need to be slightly greater forces applied through the linear member 44 as this embodiment would not have any magnetic attraction closing assist and the holding force of the hook and loop fastener would exceed that of the magnetic lips.

It is to be noted that the simplicity of the design of this device 2 allows a quick downward jerking motion on the linear member 44 to uncover and reveal the golf club, and after reinsertion of the golf club into the device 2, a quick upward jerk on the rod linear members 44 to close the device. However, it is known that the back top panel 14 may be manually opened or closed by just grabbing and directing its leading edge.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

What is claimed is:

1. A golf club head cover device comprising:

a golf club head cover forming a sleeve body, sized for the enclosure of a golf club head therein; and at least more than one rod, each having a proximate end and a distil end, said proximate end affixed to said golf club head cover and said distal end adapted for retention in a golf bag;

a gusset member connecting said rod to said to said golf club head cover;

wherein said golf club cover comprised of at least two partially separable elements, a curved body and a single, solid piece top panel, said top panel made of one material throughout, and possessing residual forces seeking to maintain said top panel in a planar, vertical orientation; and wherein said golf club head cover device opens as said rod urges said top panel into a position wherein said residual bias will raise said top cover to reveal said golf club head while said rod remains in a golf bag.

2. The golf club head cover device of claim 1 wherein the number of rods is four.

3. A golf club head cover device comprising:

a golf club head cover;

a spring panel; and four rigid rod linear members for opening and closing of said golf club head cover;

wherein said rigid rod linear members each have a proximate end and a distil end, said proximate end permanently affixed to said golf club head cover, and said distal end adapted for insertion and retention within a golf bag; and wherein said golf club head cover is a sleeve body, sized for the enclosure of a golf club head therein, said golf club cover comprised of at least two partially separable elements, a top panel and a curved body, said top panel having said spring panel disposed beneath an outer face of said top panel so as to reside entirely within said golf club head cover, said spring panel when urged upward, by a downward motion of said linear member, will straighten and maintain said top panel in a vertical open position and when a leading edge of said spring panel is urged forward, by an upward motion of said rigid rod linear members, will curl said top panel toward the curved body for the maintenance of said top panel in a vertical closed orientation.

4. The golf club head cover device of claim 3 further comprising:

a closure made of an upper, first portion closure and a lower, second portion closure;

wherein said first portion closure is affixed to said top panel and said lower, second portion closure is affixed to said curved body of said club head cover.

5. The golf club head cover device of claim 4 wherein said first portion closure is a magnetic lip affixed about an open periphery of said top panel and said second portion closure is a magnetic lip affixed about an open periphery of said curved body.

6. The golf club head cover device of claim 4 wherein said first portion closure is a hook closure forming a connectable lip affixed about an open periphery of said top panel and said second portion of said hook and loop closure is a matingly engageable lip with said connectable lip and is affixed about an open periphery of said curved body.

7. The golf club head cover device of claim 3 wherein said spring panel has a top end and a bottom end, said top end residing adjacent a leading edge of said first portion of said closure and said bottom end is affixed by said mechanical fastener to said linear member.

8. The golf club head cover device of claim 3 wherein said linear member is the operational handle that initiates the opening and closing said golf head club cover device.

9. The golf head club cover device of claim 8 wherein a downward motion of said linear member while said distal end remains in said golf bag, opens said golf head club cover, and wherein an upward motion of said linear member while said distal end remains in said golf bag, assists in closing said golf head club cover.

10. A golf club head cover device comprising:

a golf club head cover;

a spring panel; and at least one rigid rod linear member for opening and closing of said golf club head cover;

a gusset member affixed between said golf club head cover and said linear member to secure the rod configuration linear member to said golf club head cover; and wherein said rigid rod linear member has a proximate end and a distil end, said proximate end permanently affixed to said golf club head cover, and said distal end adapted for insertion and retention within a golf bag; and wherein said golf club head cover is a sleeve body, sized for the enclosure of a golf club head therein, said golf club cover comprised of at least two partially separable elements, a top panel and a curved body, said top panel having said spring panel disposed beneath an outer face of said top panel so as to reside entirely within said golf club head cover, said spring panel when urged upward, by a downward motion of said linear member, will straighten and maintain said top panel in a vertical open position and when a leading edge of said spring panel is urged forward, by an upward motion of said rigid rod linear member, will curl said top panel toward the curved body for the maintenance of said top panel in a vertical closed orientation.

11. The golf club head cover device of claim 10 wherein said club head cover has an open position and a closed position, wherein said top panel resides in a vertical orientation when said club head cover is in said open position, and wherein said top panel resides in a horizontal orientation when in a closed position.

12. The golf club head cover device of claim 10 wherein said curved body is comprised of a right side panel, a left side panel, a central panel and a bottom panel;

wherein said central panel resides adjacent to said right side panel and adjacent said left side panel, and wherein said bottom panel resides adjacent to said right side panel, said left side panel, and said central panel.

13. The golf club head cover device of claim 10 further comprising a mechanical fastener wherein said mechanical fastener affixes said golf club head cover to said gusset member.

* * * * *